United States Patent [19]

Butzen

[11] Patent Number: 4,707,954

[45] Date of Patent: Nov. 24, 1987

[54] ROOF EDGE FASCIA SYSTEM

[76] Inventor: William J. Butzen, N57 W15167 Mesa Dr., Menomonee Falls, Wis. 53051

[21] Appl. No.: 835,152

[22] Filed: Mar. 3, 1986

[51] Int. Cl.[4] ..... E04B 7/00

[52] U.S. Cl. ..... 52/96; 52/60; 52/718.1

[58] Field of Search ..... 52/96, 97, 60, 716, 52/717.1, 718.1, 58, 730

[56] References Cited

U.S. PATENT DOCUMENTS

| | | | |
|---|---|---|---|
| 3,241,271 | 3/1966 | Berg | 52/58 |
| 3,365,847 | 1/1968 | Josek | 52/94 |
| 3,404,495 | 10/1968 | Simpson, Jr. | 52/96 X |
| 3,444,658 | 5/1969 | Gobel | 52/94 |
| 3,668,811 | 6/1972 | Pollard | 52/96 |
| 4,037,372 | 7/1977 | Patry | 52/96 |

FOREIGN PATENT DOCUMENTS

| | | | |
|---|---|---|---|
| 2006443 | 8/1971 | Fed. Rep. of Germany | 52/96 |
| 2224287 | 11/1973 | Fed. Rep. of Germany | 52/96 |
| 2800003 | 7/1979 | Fed. Rep. of Germany | 52/96 |
| 1362848 | 4/1964 | France | 52/58 |
| 486619 | 4/1970 | Switzerland | 52/58 |

*Primary Examiner*—Carl D. Friedman
*Assistant Examiner*—Naoko N. Slack
*Attorney, Agent, or Firm*—Joseph S. Heino

[57] ABSTRACT

A roof edge fascia system has a base member to secure the edges of a roof-top waterproof membrane at a roof edge and an invertible complemental fascia member transposably interlockable with the base member.

3 Claims, 1 Drawing Figure

ROOF EDGE FASCIA SYSTEM

SUMMARY OF THE INVENTION

This invention relates to roof edging mechanisms used to secure the edges of a roof-top waterproof membrane and more particularly to an uncomplicated roof edge fascia system designed to act as a gravel curb, a moisture seal and an aesthetically appealing finishing trim around such roof-top edges.

The use of roof edge fascia systems to secure the edges of roof-top waterproof membranes is well known. However, in his many years of experience in the art with which the invention is concerned, the inventor has obtained no knowledge of any roof edge fascia system which possesses the uncomplicated essential features of the present invention. Furthermore, roof edge fascia systems disclosed in the prior art, such as that disclosed in U.S. Pat. No. 4,037,372 which shows a cover plate 32 interlockingly engaging a fascia receiver 30 (see FIGS. 1–4), are generally more complicated in design than the system of the present invention and are correspondingly more expensive to fabricate and more difficult to assemble in the field.

It is therefore, a principal object of this invention to provide a new, useful and uncomplicated roof edge fascia system which is economically fabricated, easily assembled in the field and which accomplishes all of this while creating an aesthetically appealing fascia system from all points outside of the building.

The present invention has obtained these objects by providing for a base member adapted to overlay and anchor the edge of a roof-top waterproof membrane to the roof edge and by providing a complemental face plate member adapted to interlockingly engage the base member. The base member comprises a metal extrusion and includes an upwardly extending portion, said portion having a channel, and a downwardly extending portion. The face plate member comprises a sheet metal material so formed as to include first and second bent-over end portions in symmetrical opposition to each other. The bent-over end portions are interchangeably adapted such that the first (or second) bent-over end portion fits over the downwardly extending portion of the loose member and the second (or first) bent-over end portion fits over and snaps into the channel of the upwardly extending portion of the base member. In this configuration, installation of the face plate member in the field is facilitated since either bent-over end portion may be used to fit over either portion of the base member. After installation, the complemental face plate member is rigidly held in place, thereby preventing the entry of water between the base member and the face plate member. The foregoing and other features of the present invention will be further apparent from the description that follows.

DETAILED DESCRIPTION

Figure 1:
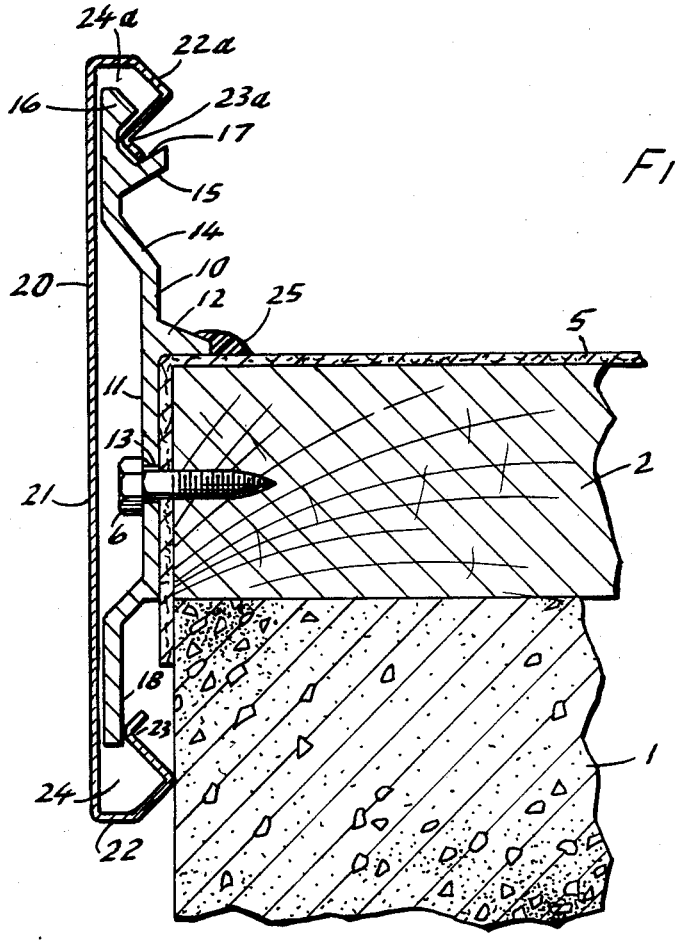
FIG. 1 is a vertical sectional view through the roof edging mechanism as installed on a roof edge.

Reference is now made more particularly to the drawing which shows the roof edge system constructed in accordance with the present invention. As shown, a waterproof membane 5 overlays and is secured to a wood nailer 2 located at the top of a wall 1. Means for securing the membrane 5 to the roof edge is provided by base member generally identified 10 which is comprised of an extruded metal material and includes a vertical hold down portion 11 and a foot portion 12. The hold down portion 11 of the base member 10 includes a hole 13 through which a fastener 6 secures the base member 10 to the wood nailer 2, thereby compressibly clamping the ede of the membrane 5 between the vertical portion 11 and foot portion 12 of the base 10 and the nailer 2. The base member 10 further includes an upwardly extending portion 14 and a downwardly extending portion 18. The upwardly extending portion 14 includes a lower flange 15 and an upper flange 16, said upper flange 16 having a projecting ridge member, which define a channel 17 at the uppermost portion of the upwardly extending portion 14.

Means for covering the base member 10 is provided by face plate member generally identified 20 which is comprised of a sheet metal material having a vertical portion 21 and first and second bent-over end portions 22, **22*a* and first and second reverse bend end portions 23, 23*a*. The bent-over end portions 22, 22*a*, and reverse bend end portions 23, 23*2* further define first and second end portion openings 24, 24*a* at each end of the face plate member 20. The openings 24, 24*a* are adapted to engage either of the upwardly or downwardly extending base member portions 14, 18. Furthermore, both reverse bend end portions 23, 23*a* are adapted to interlockingly engage the channel 17 of the upwardly extending portion 14**.

During installation of the roof edge system of the present invention, the base member 10 overlays the membrane 5 and is fastened to the wood nailer 2 by means of the fastener 6 extending through the hole 13 of the vertical hold down portion 11 of said base member 10. With the base member 10 in place, the waterproof membrane 5 is compressed so as to provide a watertight seal at the edge of the roof. While not shown, the waterproof membrane 5 may be further imbedded in a sealant type material. A sealant bead 25 may also be applied. After the base member 10 is in place, the first end portion opening 24 defined by the first bent-over end portion 22 of the face plate 20 is engaged with and pushed upwardly along the downwardly extending portion 18 of the base member 10. The second or opposite end portion opening **24*a* defined by the second bent-over end portion 22*a* is then aligned generally vertically in relation to the upwardly extending portion 14 of the base member 10. The second end portion opening 24*a* is then urged downwardly toward the upper flange 16 of the upwardly extending portion 14 until the reverse bend end portion 23*a* overlaps the projecting ridge member of said upper flange 16 and engages the channel 17. This interlock concept greatly facilitates installation of the face plate member 20 because either bent-over end portion 22, 22*a* can be used to initiate installation. After installation, the face plate member 20 is held rigidly in place thereby preventing the entry of water between the face plate 20 and the base member 10**.

From the foregoing detailed description of the illustrative embodiment of the invention set forth herein, it will be apparent that there has been provided a new, useful and uncomplicated roof edge fascia system which is economically fabricated, easily assembled in the field and which accomplishes all of this while creating an aesthetically appealing fascia system from all points outside of the building to which it is applied.

The principles of this invention having been fully explained in connection with the foregoing, I hereby claim as my invention:

1. A roof edging mechanism for securing the edge of a waterproof membrane overlying a roof which comprises a longitudinally extending base member adapted to be secured to the edge of a roof to clampingly engage the edge of a waterproof membrance at said roof edge, said base member comprising a metal extrusion and including an upwardly extending portion and a downwardly extending portion, said upwardly extending portion having a top flange, a bottom flange, and a yoke portion connecting said flanges along one side thereof, the opposite sides of said flanges being arranged to form a channel and said top flange having a ridge projecting into said channel, and a longitudinally extending and transversely symmetrical fascia member for covering said base member comprising a sheet of resilient metal material and including a vertical portion having an upper edge and a lower edge, said fascia member including means adapted to interlockingly engage said fascia member with said base member, said fascia member engagement means comprising a bent-over open mouth portion and a reverse bent-over lip portion at the upper edge of said vertical fascia portion and bent-over open mouth portion and a reverse bent-over lip portion at the lower edge of said vertical fascia portion, said upper edge bent-over open mouth and reverse bent-over lip portions being symmetrically opposed to said lower edge bent-over open mouth and reverse bent-over lip portions and both of said bent-over open mouth portions being adapted to engage either of the said upwardly extending top flange or the said downwardly extending base member portion and both of said reverse bent-over lip portions being adapted to engage said upwardly extending base member channel and projecting top flange ridge whereby said fascia member comes into operative interlocking engagement with said base member.

2. A roof edging mechanism for securing the edge of a waterproof membrane overlying a roof comprising a base member extending along an outer surface of a roof edge, said base member including a support portion having an upper edge and a lower edge, said support portion being adapted to be secured to said roof edge outer surface, a shoulder portion projecting inwardly from said support portion, said shoulder portion extending along and being adapted to rest upon an upper surface of said roof edge, an upper support portion projecting upwardly and outwardly from the upper edge of said support portion and having an upper edge and a lower support portion projecting downwardly and outwardly from the lower edge of said support portion and having a lower edge, said base member upper support portion upper edge including an upwardly extending first flange, said first flange having an inwardly extending ridge, and an upwardly and inwardly extending second flange, said first and second flanges and ridge forming a channel, and a fascia member including a vertical fascia portion extending along said base member, said vertical fascia portion having an upper edge, a lower edge, and means for interlockably engaging said upper and lower edges of said vertical fascia portion with said upper support base member portion and said lower support base member portion respectively, said fascia member engagement means comprising a bent-over open mouth portion and a reverse bent-over lip portion symmetrically located at each of the upper and lower edges of said vertical fascia portion, said bent-over open mouth portions being adapted to engage either of said upwardly extending first flange or said lower base member support portion and said reverse bent-over lip portions being adapted to engage said upper edge channel and said first flange ridge whereby said fascia member comes into operative interlocking engagement with said base member.

3. A roof edging mechanism for securing the edge of a waterproof membrane overlying a roof which comprises a longitudinally extending base member adapted to be secured to adjoining top and outer side surfaces of a roof edge, said base member including a longitudinally extending vertical support section adapted to be secured to the other side surface of said roof edge, a longitudinally extending horizontal support section connected with said vertical support section and adapted to rest upon the top surface of said roof edge, a longitudinally and upwardly extending support portion connected with said vertical support section, and a longitudinally and downwardly extending support portion connected with said vertical support portion, said upwardly extending vertical support base member portion including a longitudinally extending channel defined therein, said channel being further defined by a longitudinally extending ridge projecting therein, and a longitudinally extending fascia member adapted to engagably overlay said base member, said fascia member including a vertical main section, a first longitudinally extending receiver section located above and extending inwardly of said main section, a second longitudinally extending receiver section located below and extending inwardly of said main section, each of said receiver sections comprising a bent-over open mouth portion and a reverse bent-over lip portion, said bent-over open mouth portions being adapted to engage either of said upwardly extending or downwardly extending support portions and said bent-over lip portions being adapted to engage said upwardly extending support portion channel and projecting ridge.

* * * * *